US008578973B2

(12) United States Patent
Dillon

(10) Patent No.: US 8,578,973 B2
(45) **Date of Patent: *Nov. 12, 2013**

(54) APPARATUS AND METHOD OF FILLING DOWN-FILLED ARTICLES

(75) Inventor: Mary Stephens Dillon, Dallas, TX (US)

(73) Assignee: The Pillow Bar, LLC, Dallas, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/486,828

(22) Filed: Jun. 1, 2012

(65) Prior Publication Data

US 2012/0240529 A1 Sep. 27, 2012

Related U.S. Application Data

(63) Continuation of application No. 12/259,817, filed on Oct. 28, 2008, now Pat. No. 8,281,819.

(60) Provisional application No. 60/983,531, filed on Oct. 29, 2007.

(51) Int. Cl.
*B65B 1/04* (2006.01)

(52) U.S. Cl.
USPC ..... 141/10; 141/69

(58) Field of Classification Search
USPC ..... 141/1, 9, 10, 67, 114, 69
See application file for complete search history.

(56) References Cited

U.S. PATENT DOCUMENTS

| | | | | | |
|---|---|---|---|---|---|
| 2,060,629 | A * | 11/1936 | McJoynt | ..... | 141/10 |
| 2,799,465 | A * | 7/1957 | Carter | ..... | 177/1 |
| 3,785,410 | A * | 1/1974 | Carter | ..... | 141/10 |
| 4,114,213 | A * | 9/1978 | Beernaerts et al. | ..... | 264/257 |
| 4,664,160 | A * | 5/1987 | Rothstein et al. | ..... | 141/67 |
| 5,190,082 | A * | 3/1993 | Watson et al. | ..... | 141/1 |
| 8,281,819 | B2 * | 10/2012 | Dillon | ..... | 141/10 |

* cited by examiner

*Primary Examiner* — Davis Hwu
(74) *Attorney, Agent, or Firm* — David W. Carstens; Jeffrey G. Degenfelder; Carstens & Cahoon, LLP

(57) ABSTRACT

The apparatus and method of the subject invention facilitates the filling of an air-permeable casement or shell with feather down material. The apparatus of the subject invention includes two chambers which are selectively connected to one another by means of a passageway. The subject invention further includes a mechanism for selectively inducing a partial vacuum in either chamber to facilitate the filling of article casements with feather down. By inducing a partial vacuum in the first chamber and connecting a supply hose to its access port, feather down may be conveyed from a supply container into the first chamber. By selectively opening the passageway and inducing a partial vacuum in the second chamber, the feather down is conveyed from the first chamber to the second chamber in a clean, efficient and controlled manner where it is contained within an air permeable casement formed over the passageway.

20 Claims, 10 Drawing Sheets

APPARATUS AND METHOD OF FILLING DOWN-FILLED ARTICLES

CROSS-REFERENCE TO RELATED APPLICATION

This application is a continuation of U.S. application Ser. No. 12/259,817 filed Oct. 28, 2008, which claims the benefit of and priority to U.S. Provisional Application No. 60/983,531 filed Oct. 29, 2007, the technical disclosure of which is hereby incorporated by reference.

BACKGROUND OF THE INVENTION

1. Technical Field

The present invention relates generally to an apparatus and method for filling an assortment of articles with feather down or a feather down like material. In particular, the present invention is directed to an apparatus and method for filling pillow casements with feather down or a feather down like material in a retail environment.

2. Description of the Related Art

Feather down is used extensively in bedding and apparel. Typically obtained from birds, down is a layer of fine feathers found under the tougher exterior feathers. When used herein, the terms "feather down" or "feather down material" means both natural and man-made fibers which exhibit the commonly known characteristics of natural down. Feather down articles are typically manufactured using an outer casement or covering (commonly known as the "shell" or "tick") which holds the feather down within its confines. While a variety of fabrics may be used for the outer material, cotton is typically used because of its ability to easily wick moisture. Shells can be made from using numerous fibers (cotton, rayon, silk) and weaves (Jacquard, Dobby, Damask, Sateen, Twill). The most important feature of such shells or casements is that the surface facing the feather down is permeable to air but not to the feather down.

Feather down offers excellent thermal properties, and has good lofting characteristics. This means that the feather down traps small pockets of air efficiently. The small pockets of air provide a thermal barrier. Feather down also has the added property that it can be packed into a very small space. Down filled pillows have long been known for both their softness and their ability to conform to shapes desired by the user, more so than foam or fiber pillows.

Despite its popularity, the manufacture of down-filled articles has inherent limitations, especially with regard to a retail environment. Typically, manufacturers of down-filled articles are restricted to large manufacturing facilities located far away from retail establishments due to the inherent messiness of feather-down during the filling process. This is because feather down is typically blown or dropped into the shell of the article. The intrinsic lightness and fluffiness of the feather down inherently results in some of the down dispersing into the open air. Thus, retail establishments typically feature only finished down-filled articles for which a customer may purchase a designer cover to go over the shell.

However, it has been found that many customers desire the ability to customize the manufacture of down-filled articles. Indeed, a number of consumers have expressed a particular desire to oversee and participate in the making of down-filled sleeping or upholstery pillows in the retail environment. For example, many customers simply wish to customize the firmness of their pillows by having more control over the amount of feather down put into a particular pillow.

While a variety of proposals have previously been made to allow customers to customize plush-filled animals in a retail setting, such proposals cannot be adapted to the use of down-filled articles. All previous proposals typically use a blowing mechanism to blow the stuffing into a plush animal. This blowing technique comprises a blower motor to propel a relatively heavy synthetic type filling into the animal shaped fabric casement. However, such casement filling processes which involve blowing will not allow for the conveyance of feather down filling in a clean and efficient manner. Feather down has virtually no mass and very minimal weight, making it virtually impossible to control using a blowing technique. The use of a prior art "blowing" technique to fill a fabric casement with feather down would inherently create a terrible mess in a retail establishment.

Thus, a need exists for an improved apparatus and method for using same which will allow the customized manufacture of feather-down articles in a retail setting. Further, a need exists for an improved apparatus and method for manufacturing feather-down articles which is more efficient and cleaner.

SUMMARY OF THE INVENTION

The apparatus of the subject invention is a free-standing mobile unit that allows customers to instantly make and purchase 100% feather down filled articles, such as sleeping pillows or other pillows of any recognized size (king, queen, standard, euro/dog or travel) complete with personalized embroidered exterior liner and aromatic herb sachet.

The apparatus and method of the subject invention facilitates the filling of an air-permeable casement or shell with feather down by inducing a partial vacuum on the exterior of the fabric casement thereby causing the feather down to be sucked into the bag in a clean, efficient and controlled manner. The apparatus of the subject invention includes two chambers which are selectively connected to one another by means of a passageway. The subject invention further includes a mechanism for selectively inducing a partial vacuum in either chamber to facilitate the filling of article casements with feather down. By inducing a partial vacuum in the first chamber and connecting a supply hose to its access port, feather down may be conveyed from a supply container into the first chamber. By selectively opening the passageway and inducing a partial vacuum in the second chamber, the feather down is conveyed from the first chamber to the second chamber where it is contained within an air permeable casement formed over the passageway.

The customer can monitor and customize the filling process, therefore making the article to any desired firmness and consistency. The apparatus and method of the subject invention further allows customers for the first time in a retail environment to participate in the making and customization of feather-down articles, such as sleeping or decorator pillows of any shape or size.

The apparatus and method of the subject invention is appropriate for a retail environment as well as a commercial environment, in that it is quiet, clean and manageable. For the first time ever, a retail customer is able to monitor and participate in the manufacture and customization of a wide variety of down-filled articles such as pillows.

The use of the vacuum process allows for the clean, managed and direct movement of the feather down into a fabric shell or casement. Furthermore, a novel exhaust conduit attached to a vacuum motor enhances the flow of the feather down into the casement article by continuously fluffing and moving the feather down during the filling process, thereby preventing the feather down from compacting tightly or clogging the filling nozzle.

BRIEF DESCRIPTION OF THE DRAWINGS & PHOTOGRAPHS

A more complete understanding of the method and apparatus of the present invention may be had by reference to the following detailed description when taken in conjunction with the accompanying drawings, wherein.

Figure 1A:
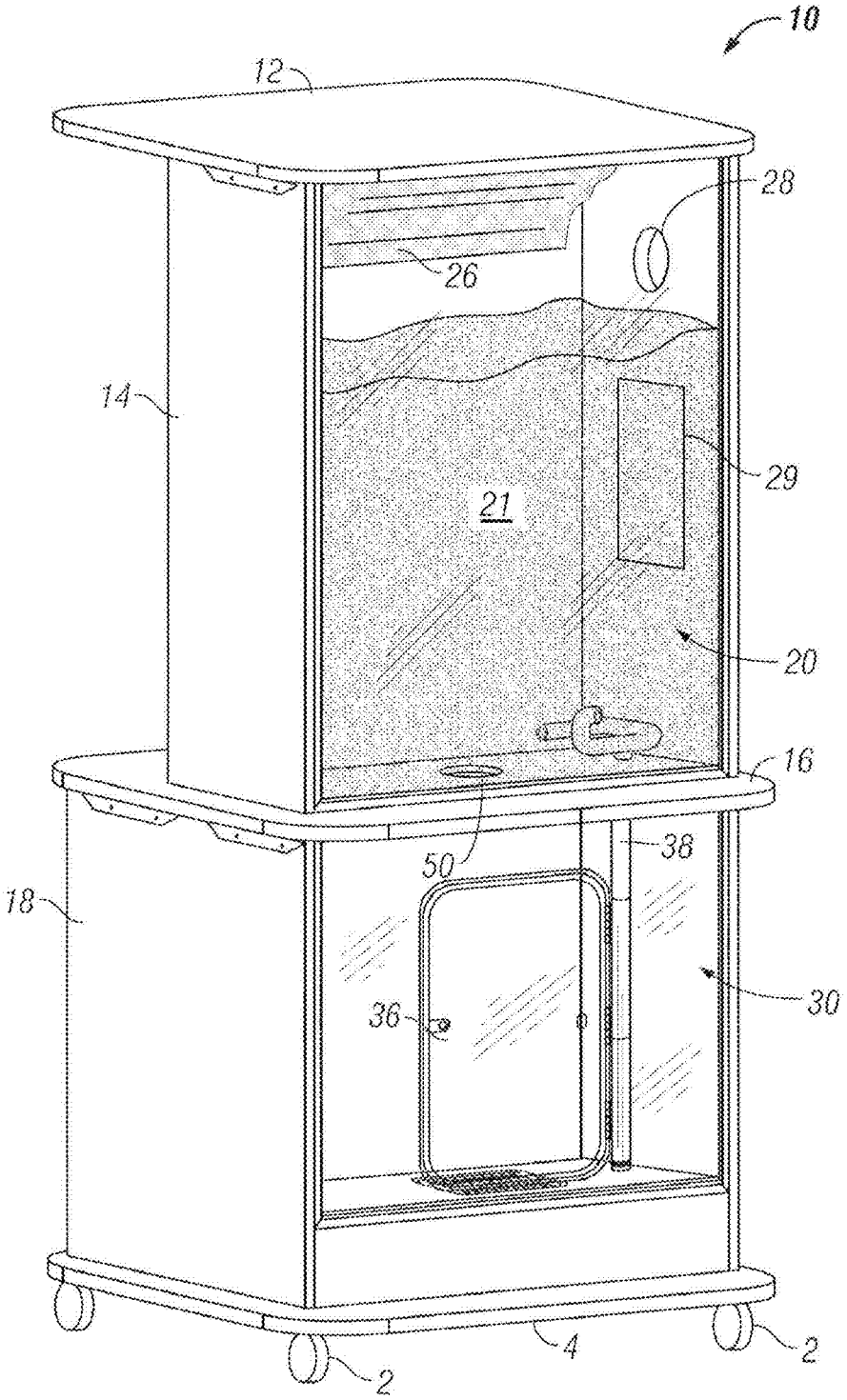
FIG. 1A is a perspective view of an embodiment of the apparatus of the present invention depicting a storage chamber full of feather down material.
Figure 1B:
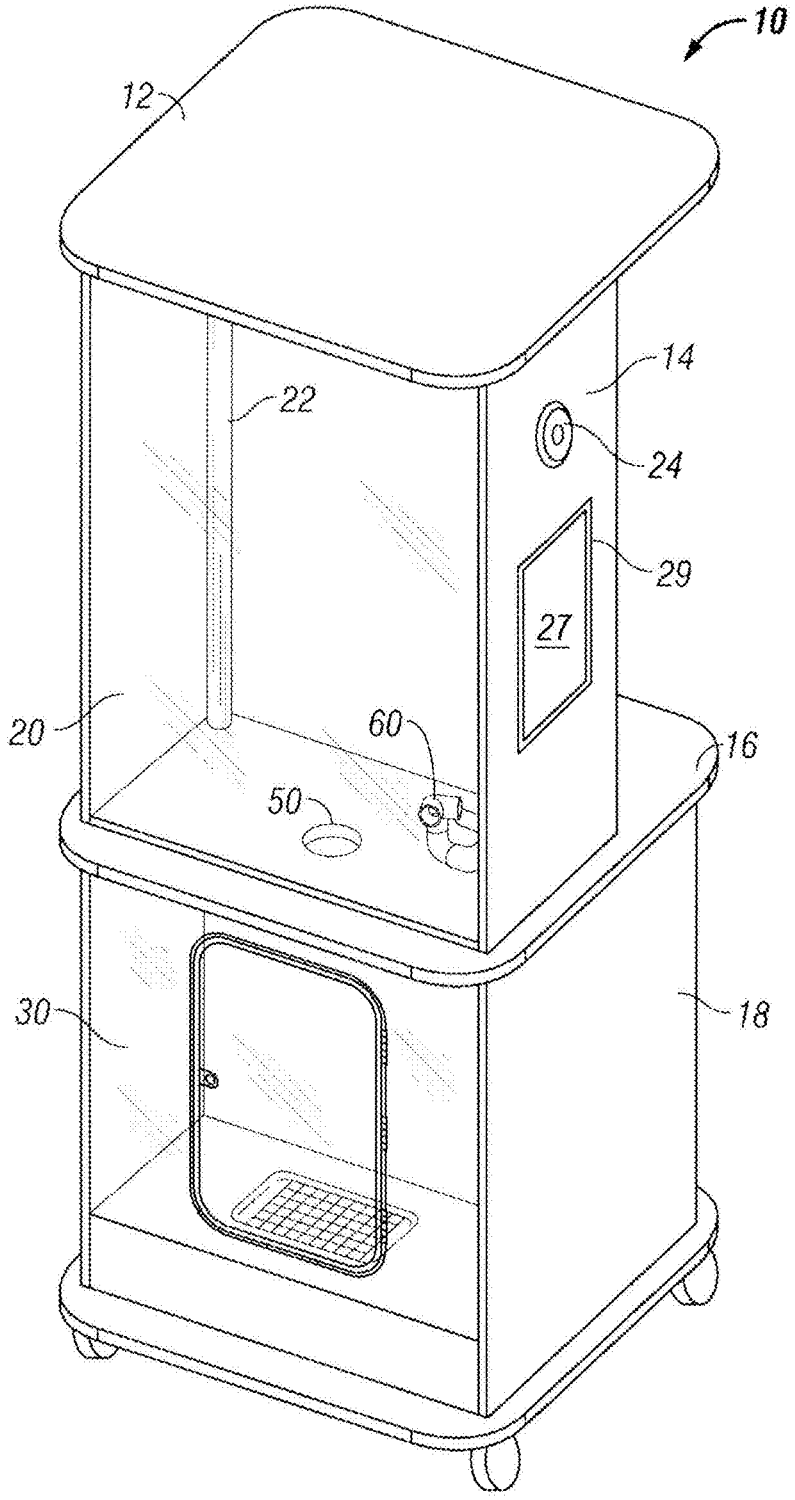
FIG. 1B is another perspective view of the embodiment of the apparatus of the present invention shown in FIG. 1A depicting an empty storage chamber
Figure 2:
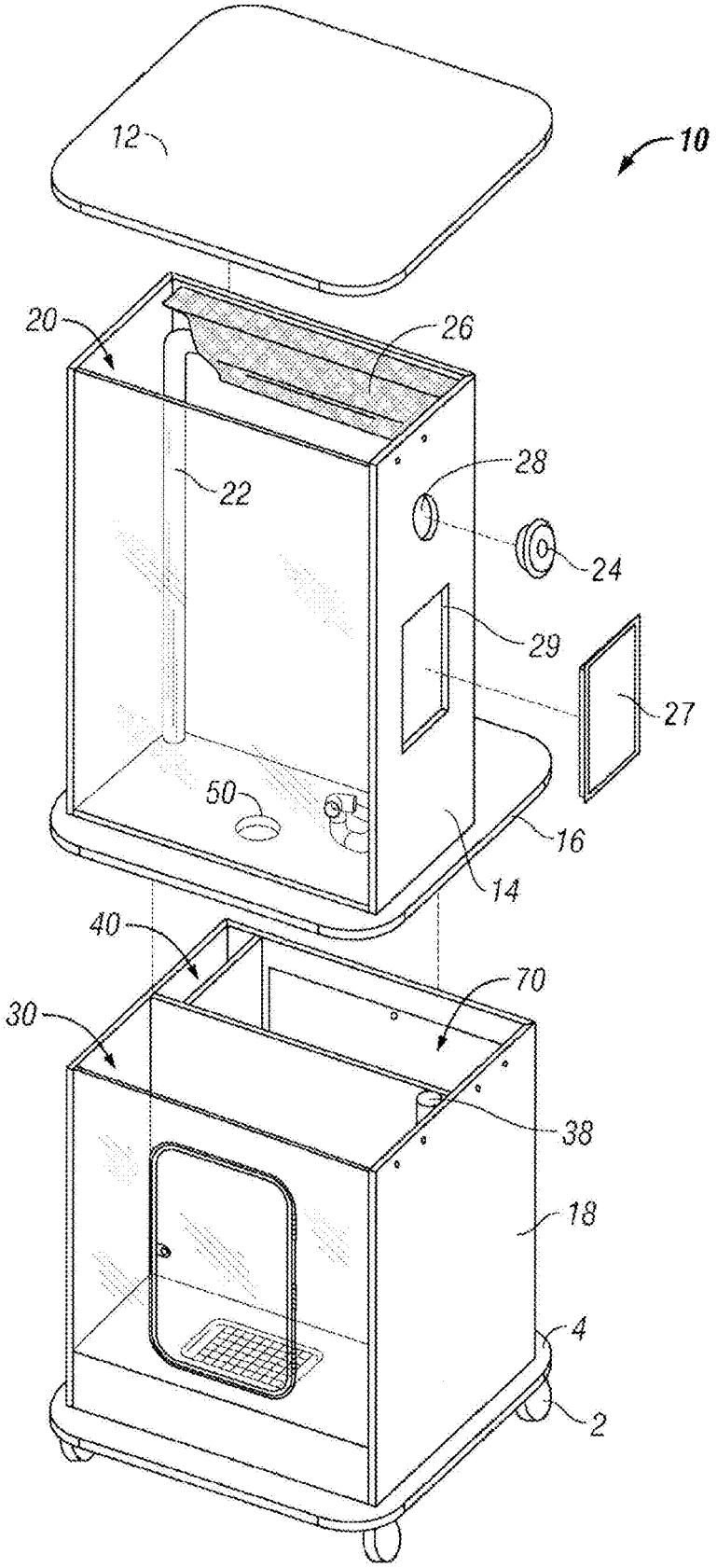
FIG. 2 is an exploded perspective view of the embodiment of the apparatus of the present invention shown in FIG. 1B.
Figure 3:
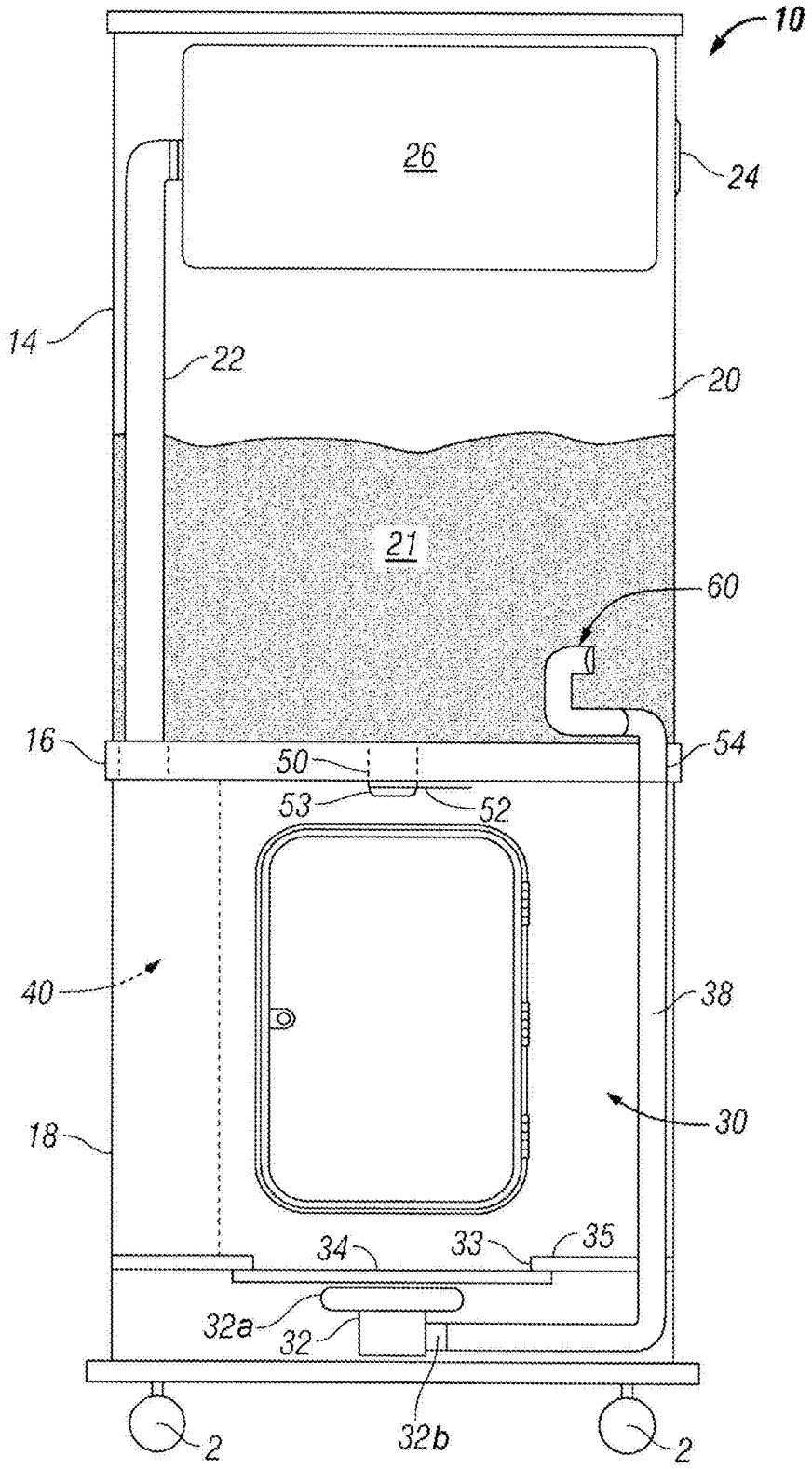
FIG. 3 is a front elevation view of the embodiment of the apparatus of the present invention shown in FIG. 1.
Figure 4:
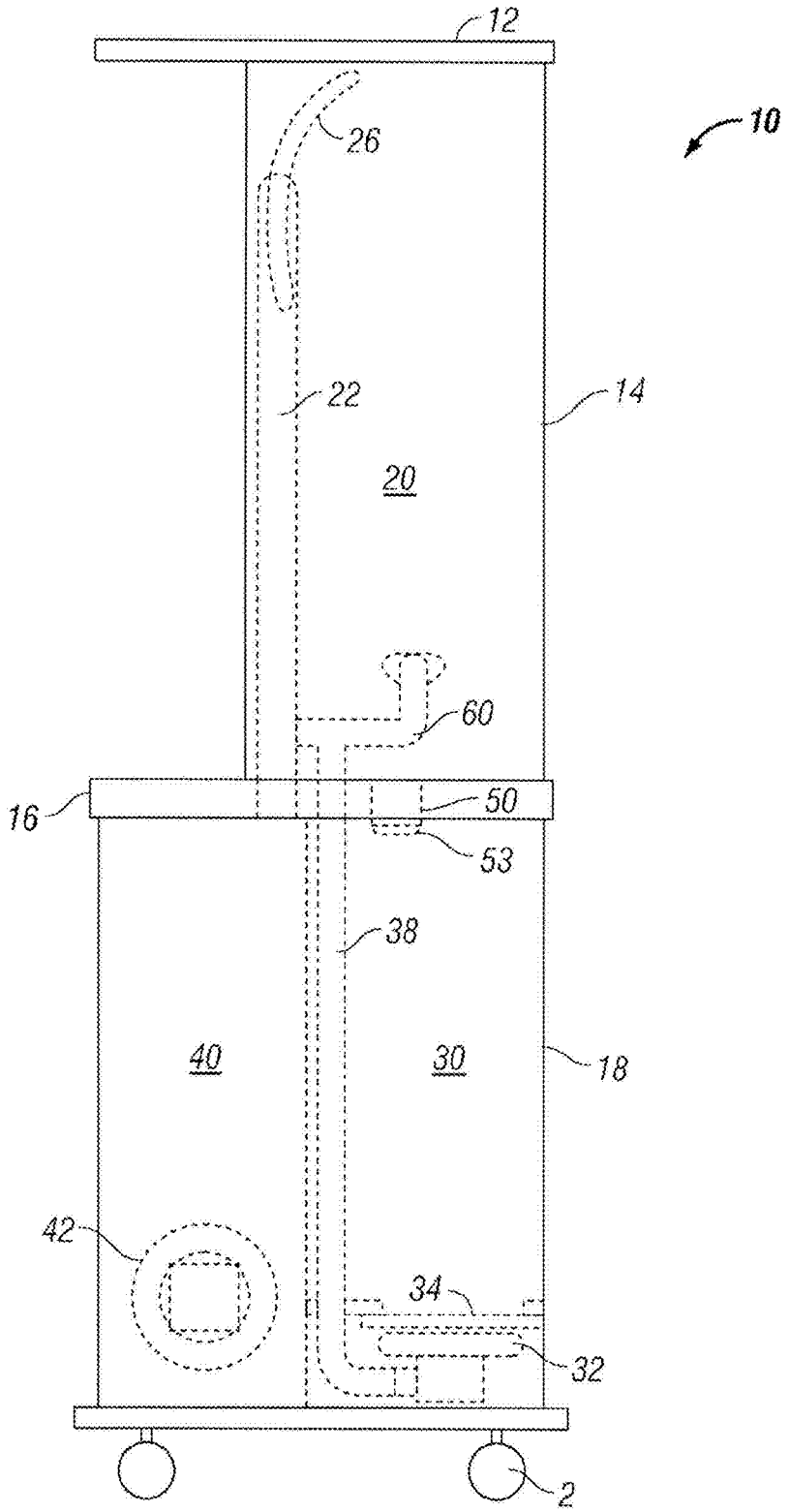
FIG. 4 is a view of the left side of the embodiment of the apparatus of the present invention shown in FIG. 1.
Figure 5:
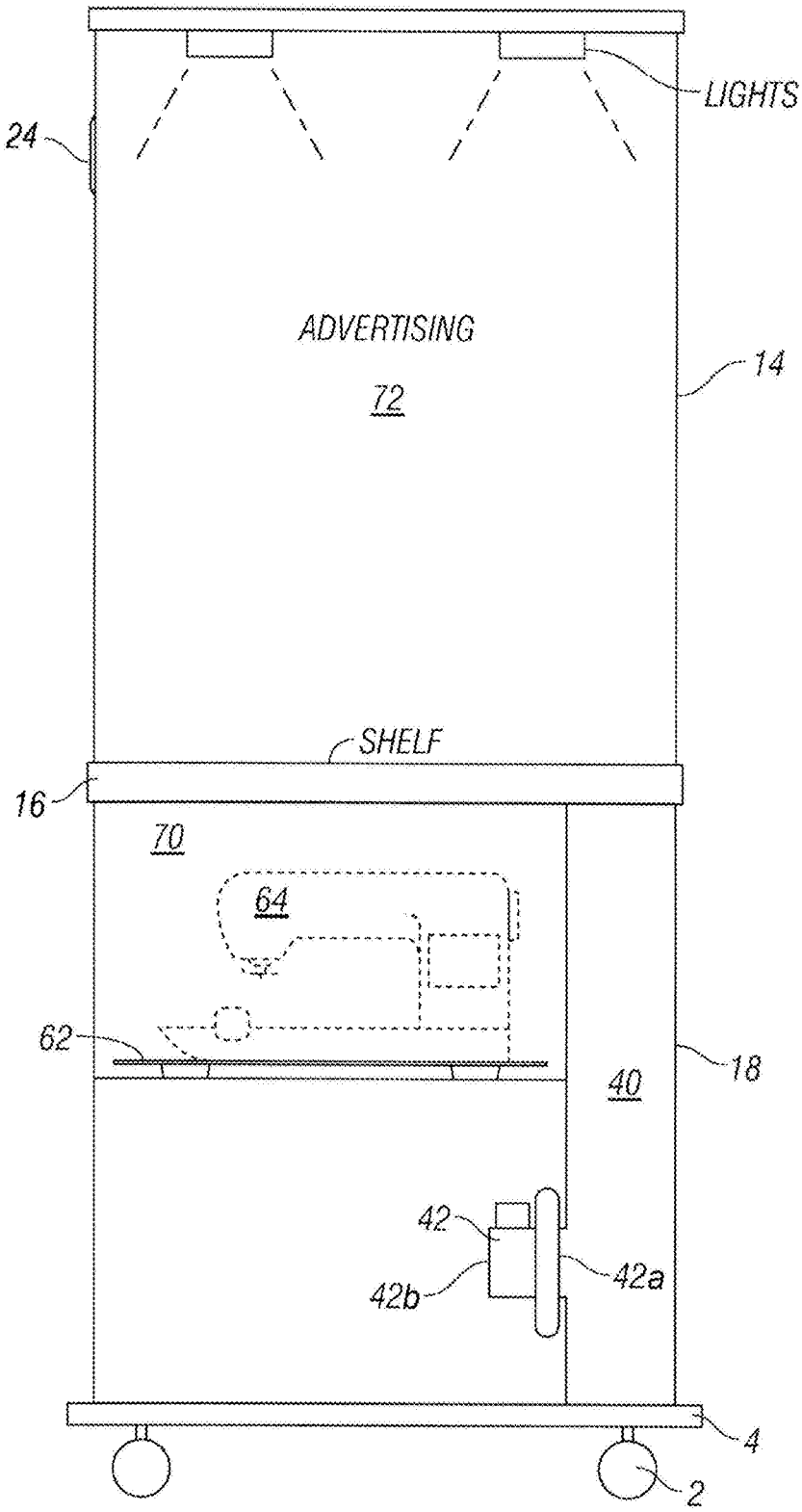
FIG. 5 is a view of the back of the embodiment of the apparatus of the present invention shown in FIG. 1.
Figure 6:
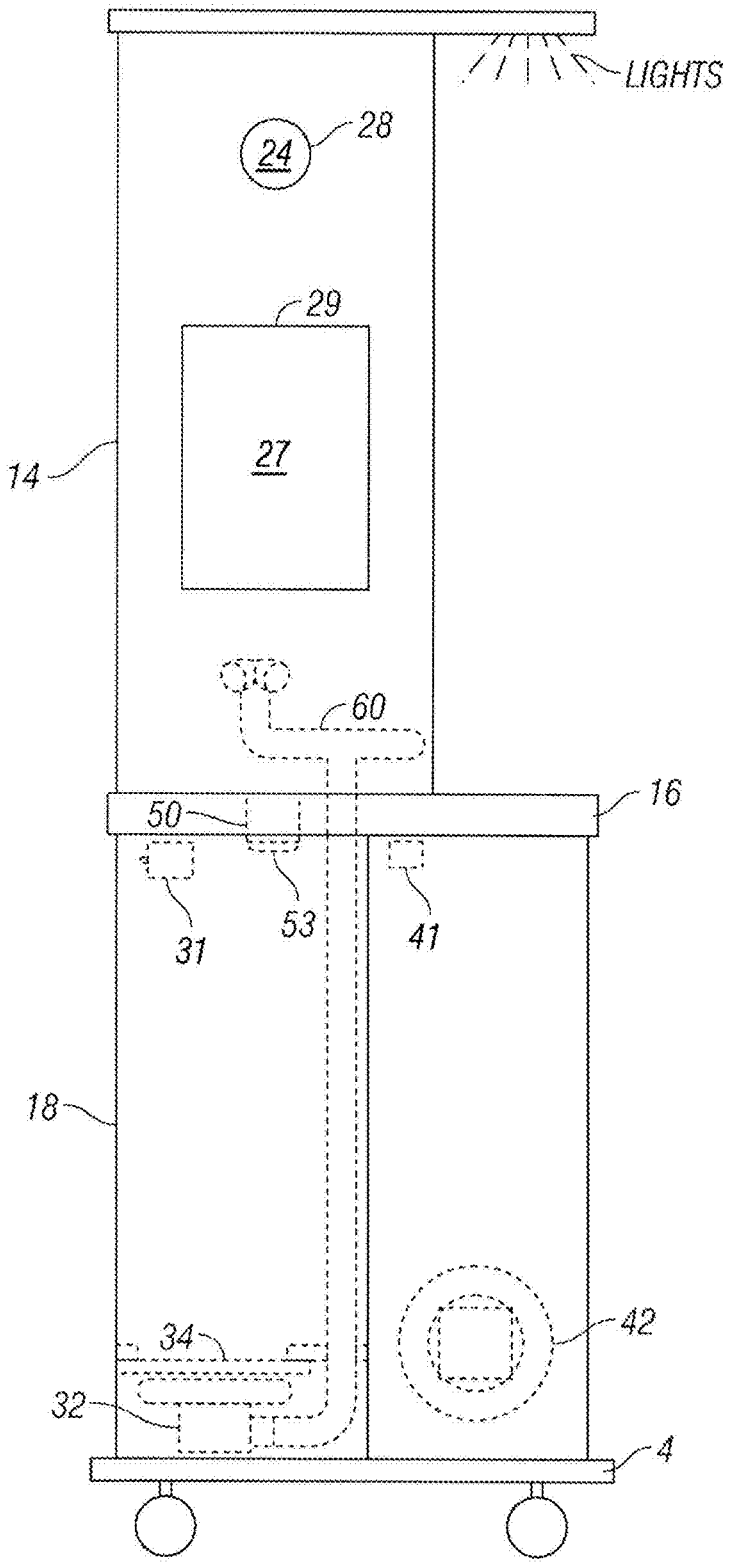
FIG. 6 is a view of the right side of the embodiment of the apparatus of the present invention shown in FIG. 1.
Figure 8A:
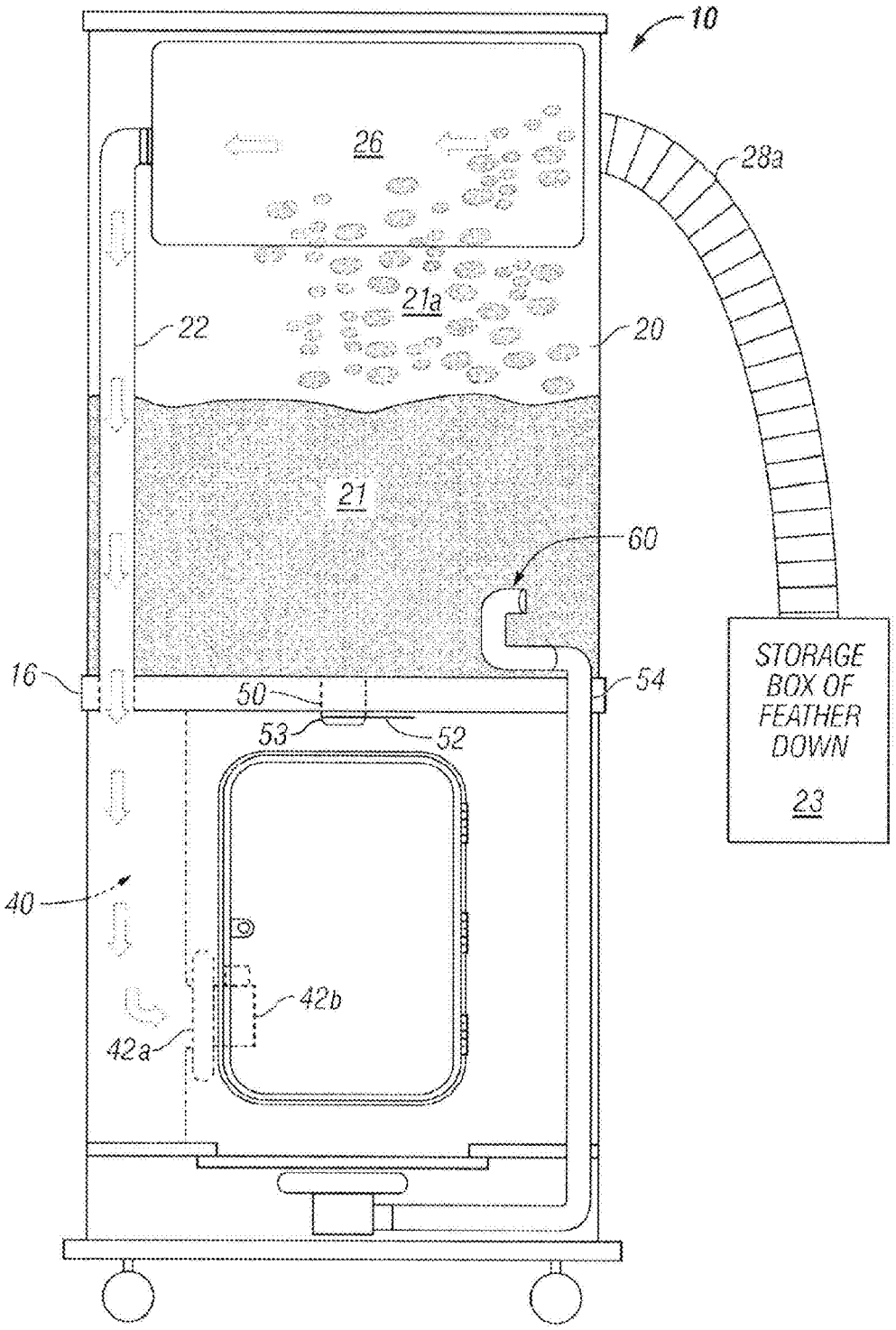
Figure 8B:
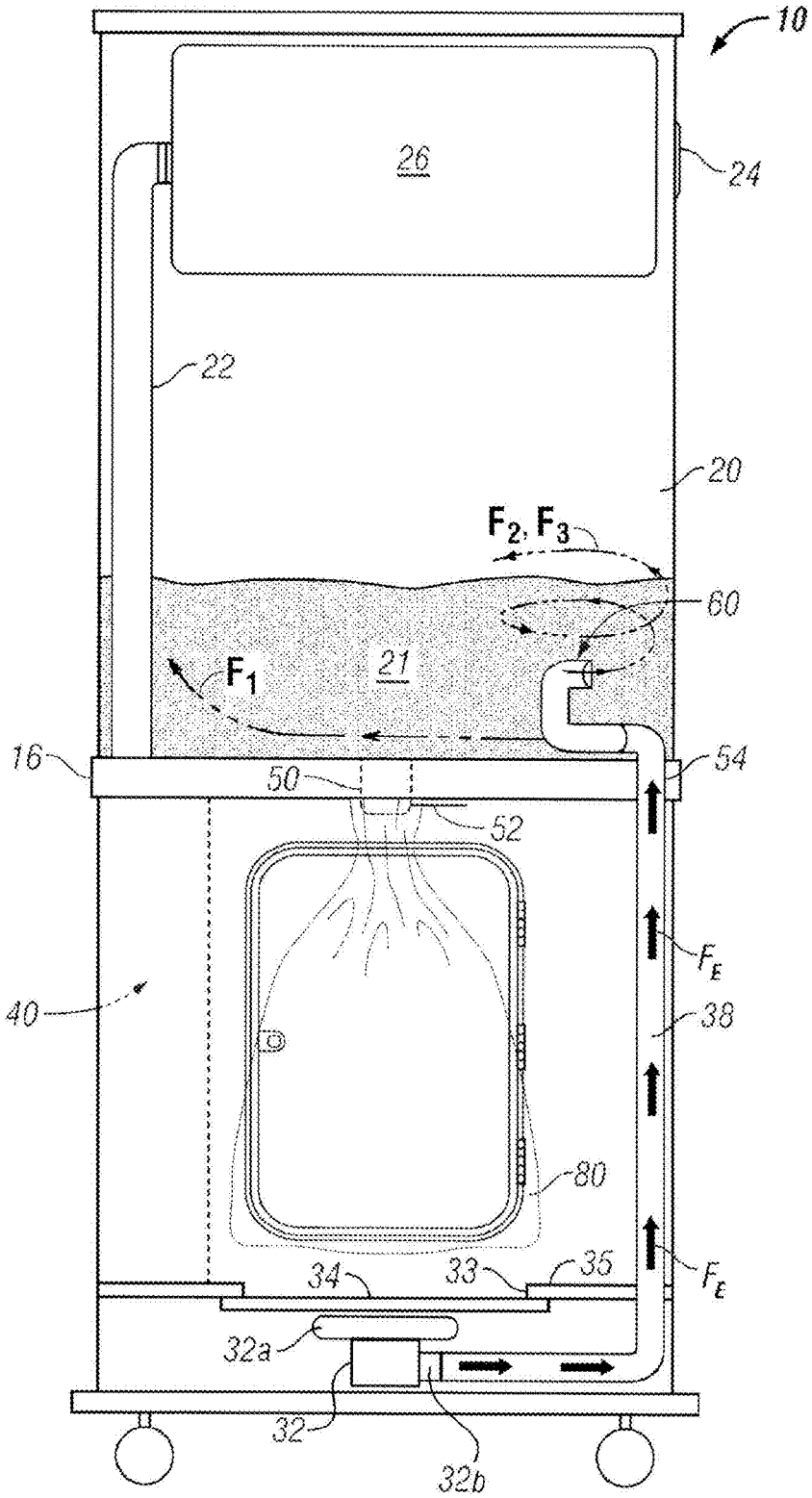

FIG. 8A is a front elevation view of the embodiment of the apparatus of the present invention shown in FIG. 1 demonstrating the filling the storage chamber of the present invention with feather down in accordance with the method of the present invention; and FIG. 8B is a front elevation view of the embodiment of the apparatus of the present invention shown in FIG. 1 demonstrating the filling an article casement with feather down in accordance with the method of the present invention.

Where used in the various figures of the drawing, the same numerals designate the same or similar parts. Furthermore, when the terms "top," "bottom," "first," "second," "upper," "lower," "height," "width," "length," "end," "side," "horizontal," "vertical," and similar terms are used herein, it should be understood that these terms have reference only to the structure shown in the drawing and are utilized only to facilitate describing the invention.

DETAILED DESCRIPTION OF THE INVENTION

The apparatus of the subject invention includes two chambers which are selectively connected to one another by means of a passageway. The subject invention further includes a mechanism for selectively inducing a partial vacuum in either chamber to facilitate the filling of article casements with feather down. While the two chambers are substantially air tight, they each include means for selectively accessing their interiors. By inducing a partial vacuum in the first chamber and connecting a supply hose to its access port, feather down may be conveyed from a supply container into the first chamber. By selectively opening the passageway and inducing a partial vacuum in the second chamber, the feather down is conveyed from the first chamber to the second chamber where it is contained within an air permeable casement formed over the passageway. In addition, a pressurized exhaust flow can be directed into the first chamber where it continually fluffs the feather down preventing the feather down from compacting tightly or clogging the passageway. In a preferred embodiment the pressurized exhaust flow is generated by the exhaust of the vacuum inducing mechanism.

With reference now to the Figures, an embodiment of the apparatus of the subject invention 10 is shown. The subject invention 10 includes two vacuum chambers 20, 30, which are selectively connected to one another, and means for selectively inducing a partial vacuum in either chamber to facilitate the filling of article casements with feather down. The two vacuum chambers 20, 30 are stacked one on top of the other and housed in a free-standing mobile cabinet unit comprised of an upper cabinet 14 having a top 12 and a lower or base cabinet 18 having a bottom 4. As depicted in the Figures, the bottom 4 may further include multiple caster wheel mechanisms 2 for increased mobility and maneuverability.

The first or upper vacuum chamber 20, which is housed in the upper cabinet 14, is used as a holding tank or storage chamber for the feather down material 21. The second or lower vacuum chamber 30 is housed in the lower or base cabinet 18 and is used for filling the actual article casement. While the two vacuum chambers 20, 30 are substantially air tight, they each include means for selectively accessing their interiors. For example, the lower chamber 30 includes a hinged door 36 formed in the front face of the chamber which allows an operator to access the chamber 30. Similarly, the upper chamber 20 includes a refill access port 28 and a larger maintenance access port 29 for cleaning and repairs of the upper chamber 20. A plug 24 and panel 27 are provided to close the refill access port 28 and maintenance access port 29, respectively, when access is not required. While the embodiment shown in the Figures depicts both of the vacuum chambers as having translucent fronts, it is understood that either of the chambers may also be constructed, either partially or entirely, of opaque material.

The two vacuum chambers 20, 30 are fluidly connected by means of an aperture or passageway 50. In the embodiment depicted in the Figures, the passageway 50 extends through a divider shelf 16 that separates the two vacuum chambers 20, 30 from each other. The passageway 50 may further include an exit or filling nozzle 53 which extends into the lower chamber 30 facilitating the attachment of a casement for filling. The passageway 50 may be selectively opened or closed by means of a gate mechanism 52. The gate mechanism 52 prevents the feather down in the upper chamber 20 from entering the lower chamber until desired. The gate mechanism 52 depicted in the Figures comprises a simple blast gate assembly that is mechanically actuated from within the lower chamber 30. It is understood that the gate mechanism 52 may also comprise an electrically actuated gate assembly. Moreover, the gate mechanism 52 may further comprise linkages which allow its mechanical actuation from the exterior of the lower chamber 30.

The subject invention 10 further includes a mechanism for selectively inducing a partial vacuum in either of the vacuum chambers 20, 30. In addition, the subject invention 10 may also include a pressurized exhaust flow $F_E$, which is directed into the first or upper chamber 20 when a partial vacuum is induced in the second or lower chamber 30. The pressurized exhaust flow $F_E$ continually agitates and fluffs the feather down preventing the feather down from compacting tightly or clogging the passageway. In a preferred embodiment the pressurized exhaust flow $F_E$ comprises the pressurized exhaust from the vacuum inducing mechanism.

For example, as shown in the embodiment depicted in the Figures, the vacuum inducing mechanism comprises two vacuum pumps 32, 42 having respective intakes 32*a*, 42*a*, which are each in fluid communication with one of the two vacuum chambers 20, 30. In addition, the two pumps 32, 42 are controlled by means of respective switches 31, 41 located on the side the subject invention 10.

The upper chamber 20 is fluidly connected to the intake 42*a* of a first vacuum pump 42 configured within a portion of the lower base cabinet 18, which is accessible at the rear of the apparatus 10. In one embodiment, the first vacuum pump 42 comprises a GRAINGER® 5.7" electrical vacuum pump. The intake 42*a* of the first vacuum pump 42 is in fluid communication with the upper chamber 20 via an accessory chamber 40 formed in the lower base cabinet 16 and a conduit 22 extending from the accessory chamber 40 to the upper chamber 20. While housed in the lower base cabinet 18, the accessory chamber 40 and first vacuum pump 42 are both isolated from the lower vacuum chamber 30. A first filtering mechanism 26 is attached to the distal end of conduit 22, and situated towards the top of the upper chamber 20. In one embodiment, the first filtering mechanism 26 comprises a polypropylene cloth material suspended on a curved grid frame. In an preferred embodiment, the first filtering mechanism 26 comprises a diatomaceous earth (DE) filter grid model number FG-1005 manufactured by UNICEL® for swimming pool filtration. It has been further noted that using a relatively large filtering mechanism 26 in comparison to the cross-sectional area of the conduit 22, permits a vacuum force which is sufficient for drawing feather down from an external supply box but does not result in a clumping of the feather down on the filter element.

Similarly, the lower chamber 30 is fluidly connected to the intake 32*a* of a second vacuum pump 32 configured within a portion of the lower base cabinet 18 below the lower chamber 30. The lower chamber 30 includes a floor 35 having a vent or hole 33 formed therein. The second vacuum pump 32 is positioned under the floor 35 of the lower chamber 30 and is aligned so that its intake has access to the vent 33 formed in the floor 35. In one embodiment, the second vacuum pump 32 comprises a GRAINGER® 5.7" electrical vacuum pump. Moreover, the intake 32*a* of the second vacuum pump 32 is preferably positioned directly beneath passageway 50 connecting the upper chamber 20 to the lower chamber 30.

A second filter mechanism 34 is positioned between the chamber vent 33 and the intake 32*a* of the second vacuum pump 32. In one embodiment, the second filter mechanism 34 comprises an air-permeable woven cloth material suspended on a grid framework. In a preferred embodiment, the second filtering mechanism 34 comprises a polypropylene cloth material covering a filter frame plate having a plurality of holes formed therethrough. Thus, the intake 32*a* of the second vacuum pump 32 is in fluid communication with the second or lower vacuum chamber 30 via the second filter mechanism 34 and the vent 33.

The exhaust 32*b* of the second vacuum pump 32 is in fluid communication with the first or upper vacuum chamber 20. The flow of pressurized exhaust air $F_E$ from the second vacuum pump 32 is vented to the upper chamber 20 using conduit 38. The conduit 38 channels the flow of pressurized exhaust air $F_E$ from the second vacuum pump 32 through the lower vacuum chamber 30 up and into the upper vacuum chamber 30.

In a preferred embodiment of the subject invention 10, the flow of exhaust air $F_E$ from the second vacuum pump 32 is fluidly connected to an exhaust manifold 60 located in the upper vacuum chamber 20. As depicted in the Figures, the exhaust manifold 60 serves to redirect and diffuse the flow of exhaust air $F_E$ from the second vacuum pump 32 in order to continuously fluff and stir the feather down material 21 during the filling process. This continual agitation of the feather down material 21 prevents it from compacting tightly or clogging the filling nozzle 53 during the filling process. In preliminary embodiments of the subject invention, a recurring problem stemmed from the feather down material 21 compacting and clogging the passageway 50 when a partial vacuum was induced in the lower chamber 30. The disclosed exhaust manifold 60 has been developed to alleviate this problem.

With reference to the Figures, and particularly FIGS. 7A-7D, two embodiments 60*a*, 60*b* of the exhaust manifold 60 are shown. Each of the disclosed embodiments of the exhaust manifold 60 is designed to divide and redirect the pressurized exhaust flow $F_E$ from the second vacuum pump 32. Regardless of which embodiment is utilized, the pressurized exhaust flow $F_E$ enters the manifold 60 via an inlet 61, which is fluidly connected to conduit 38. As depicted Figures, the embodiment of the subject invention requires a 90° connection fitting between the conduit 38 and the exhaust manifold 60 in order to properly orient the exhaust manifold 60 within the upper chamber 20. As shown in the Figures, the exhaust manifold 60 is preferably aligned near the bottom of the upper chamber 20.

Figure 7A:
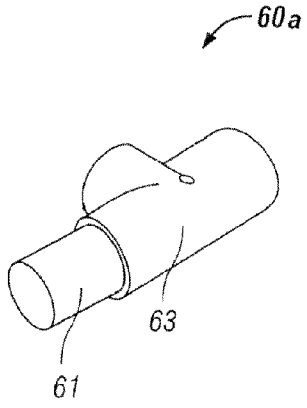
FIG. 7A is a perspective view of an embodiment of the novel exhaust manifold for the embodiment of the apparatus of the present invention shown in FIG. 1.
Figure 7C:
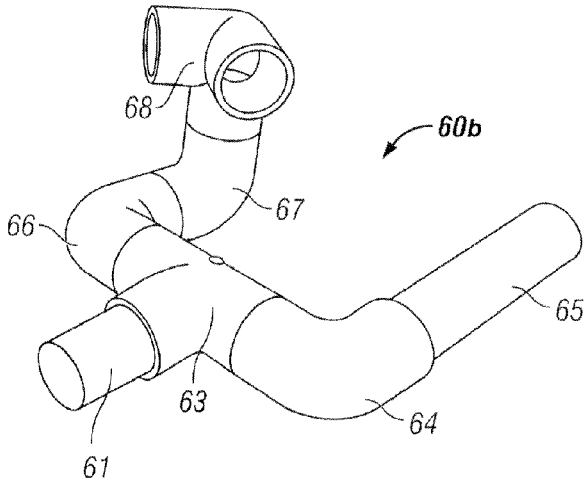
FIG. 7C is a perspective view of an alternate embodiment of the novel exhaust manifold for the embodiment of the apparatus of the present invention shown in FIG. 1.
Figure 7B:
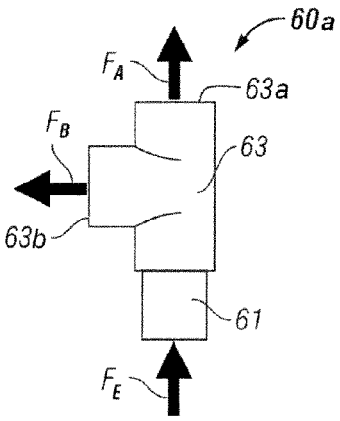
FIG. 7B is an overhead view of the embodiment of the exhaust manifold shown in FIG. 7A.

As shown in FIGS. 7A-7B, one embodiment of the exhaust manifold 60*a* comprises a simple T-fitting 63, in fluid communication with conduit 38. The exhaust flow $F_E$ enters the manifold 60*a* via an inlet 61. The exhaust manifold 60*a* divides the exhaust flow $F_E$ into two diverging flows $F_A$, $F_B$, which are directly introduced into the upper chamber 30 via nozzle exits 63*a*, 63*b*. The two diverging flows $F_A$, $F_B$ are directed in two different directions within the upper chamber 30. The two diverging flows $F_A$, $F_B$ are aligned substantially horizontal and configured parallel to the bottom of the upper chamber 20. The first nozzle exit 63*a* directs the first divergent flow $F_A$ laterally across the width of the first chamber 20 and towards the passageway 50, which connects the first chamber 20 with the second chamber 30. The second nozzle exit 63*b* directs the second divergent flow $F_B$ in a different direction from the first divergent flow $F_A$. While the embodiment of the exhaust manifold 60*a* disclosed in the Figures depicts the second divergent flow $F_B$ configured at a substantially right angle in relation to the direction of the first divergent flow $F_A$, it is understood that the relative angle may be either obtuse or acute. The embodiment of the exhaust manifold 60*a* is typically positioned in close proximity to one of the sides of the upper chamber 30. When properly configured within the upper chamber 30, the second divergent flow $F_B$ directed out of the second nozzle exit 63*b* quickly impinges upon the sides of the upper chamber 30 inducing a turbulent flow. The turbulent flow from the second nozzle exit 63*b* when combined with the lateral flow from the first nozzle exit 63*a* sufficiently agitates, fluffs and stirs the feather down material 21, thereby preventing it from compacting tightly or clogging the passageway 50 or filling nozzle 53.

Figure 7D:
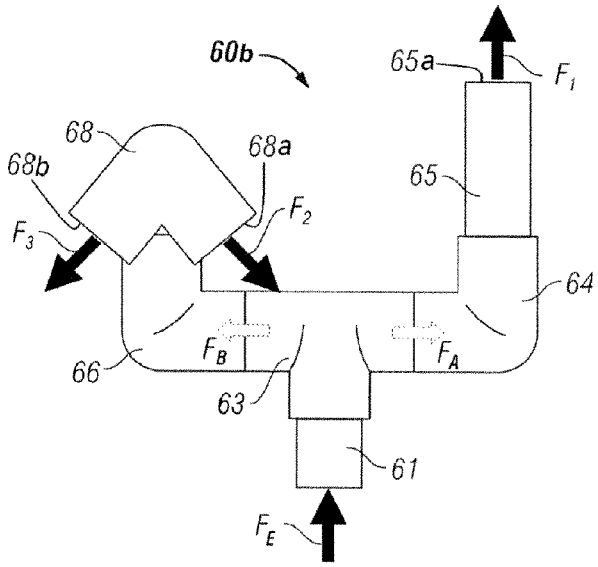
FIG. 7D is an overhead view of the alternate embodiment of the exhaust manifold shown in FIG. 7C.

As shown in FIGS. 7C-7D, an alternate embodiment of the exhaust manifold 60*b* comprises a T-fitting 63, which divides the pressurized exhaust flow $F_E$ from conduit 38 into two diverging flows $F_A$, $F_B$, which are redirected at approximate right angles from the original direction of the pressurized exhaust flow $F_E$. The two diverging flows $F_A$, $F_B$ are subsequently redirected back approximately 90 degrees by elbow conduits 64, 66. The exhaust manifold 60*b* further includes a first exhaust nozzle 65 which directs one of the diverged exhaust flows $F_A$ directly out a nozzle exit 65*a* into the upper chamber 30. When properly configured within the upper chamber 30, the length of the exhaust nozzle 65 is preferably aligned parallel with the floor and rear wall of the upper vacuum chamber 30. The exhaust manifold 60*b* further includes a second exhaust nozzle 68 which is laterally offset from the first exhaust nozzle 65. The second exhaust nozzle 68 elevates, divides and redirects the other diverged exhaust flows $F_B$.

As shown in the embodiment 60*b* depicted in FIG. 7C, the second exhaust nozzle 68 includes two nozzle ports or exits 68*a*, 68*b*, which are aligned at approximate right angles to one another. The second exhaust nozzle 68 divides the other diverged exhaust flow $F_B$ into two subsidiary flows $F_2$, $F_3$ which are aligned at obtuse angles from the direction of flow $F_1$ from the first exhaust nozzle 65. As shown in the Figures, the exhaust manifold 60*b* is typically positioned in close proximity to one of the sides of the upper chamber 30. When properly configured within the upper chamber 30, the two subsidiary flows $F_2$, $F_3$ ejected from the second exhaust nozzle 68 quickly impinge upon the sides of the upper chamber 30 inducing counter-rotating vortices. When the counter-rotating subsidiary flows $F_2$, $F_3$ from the second exhaust nozzle 68 are combined with the flow $F_1$ from the first exhaust nozzle 65 a whirlwind effect is induced in the upper vacuum chamber 30. This induced whirlwind effect continuously fluffs and stirs the feather down material 21 during the filling process, thereby preventing the feather down material 21 from compacting tightly or clogging the passageway 50 or filling nozzle 53.

With reference now to the Figures, and in particular FIGS. 8A-8B, the method of the present invention will be applied to and demonstrated with the embodiment of the subject invention 10 depicted therein. The upper chamber 20 is first filled with feather down 21 by removing plug 24 and connecting a supply hose 28*a* to a refill access port 28 formed in the cabinet side of the upper chamber 20. In one embodiment, the supply hose 28*a* comprises a 3" pharmaceutical non-static hose with reinforced ribbing. The free end of supply hose 28*a* is fluidly connected to a storage container 23 having a supply of feather down material. The passageway 50 between the upper 20 and lower 30 chambers is closed by means of the gate mechanism 52 being configured in the closed position.

As shown in FIG. 8A, upon activation of the first vacuum pump 42 a partial vacuum is induced in the upper chamber 20, drawing the feather down material 21*a* from the storage container through the supply hose 28*a* and into the upper chamber 20 via the refill access port 28. As noted previously, the intake 42*a* of the first vacuum pump 42 is fluidly connected to the upper chamber 20 via accessory chamber 40 and a conduit 22 extending from the accessory chamber 40 to the upper chamber 20. The exhaust 42*b* of the first vacuum pump 42 vents to the ambient atmosphere. Thus, when the first vacuum pump 42 is energized, an airflow in the direction of the dashed arrows is created from the upper chamber 20 to the first vacuum pump 42, which induces a partial vacuum in the upper chamber 20. The first filtering mechanism 26 attached to the distal end of conduit 22 prevents the feather down material 21*a* from entering conduit 22. It has been noted that positioning the first filtering mechanism 26 near the top of the upper chamber 20 and diffusing the vacuum force across a relatively large filtering mechanism, the induced vacuum force is sufficient to draw feather down material 21*a* into the upper chamber 20 where it tends to clump together and fall away from filtering mechanism 26 towards the bottom of the upper chamber due to gravitational forces. Consequently, the feather down material 21*a* is quickly and cleanly drawn into the upper chamber 20 to await further use. Once the upper chamber 20 is sufficiently filled, the first vacuum pump 42 is turned off, the supply hose 28*a* is removed, and the refill access port 28 is again closed with plug 24.

With reference to the Figures, and in particular FIG. 8B, the method for filling article casements with feather down material is illustrated. The article filling process comprises securing an empty, air-permeable article liner or casement 80 onto the filling nozzle 53 of the passageway 50. In a preferred embodiment, the filling nozzle 53 of the passageway 50 comprises a 4" diameter tube. The blast gate mechanism 52 is then opened. Upon activation of the second vacuum pump 32 a partial vacuum is imparted in the second or lower vacuum chamber 30 causing the feather down material 21 to be sucked down from the upper chamber 20 through passage way 50 and into the article liner or casement 80. As discussed previously, a pressurized exhaust $F_E$ is injected into the first or upper chamber 20 in order to fluff and stir the feather down material 21 during the filling process. For example, as shown in the embodiment of the subject invention 10, the pressurized exhaust $F_E$ from the second vacuum pump 32 is simultaneously re-routed from the exhaust port 32*b* through conduit 38 and an exhaust manifold 60 into the first or upper chamber 20 inducing a whirlwind effect in the chamber 20.

For example, in the embodiment 60*b* of the exhaust manifold 60 depicted in FIG. 8B, the second exhaust nozzle 68 elevates, divides and directs two air flows $F_2$, $F_3$ so that they quickly impinge upon the sides of the upper chamber 30 inducing counter-rotating vortices. When the counter-rotating flows $F_2$, $F_3$ from the second exhaust nozzle 68 are combined with the linear flow $F_1$ from the first exhaust nozzle 65, which traverses the lateral width of the upper chamber 20, a whirlwind effect is induced in the upper vacuum chamber 30. This induced whirlwind effect continuously fluffs and stirs the feather down material 21 during the filling process, thereby preventing the feather down material 21 from compacting tightly or clogging the passageway 50 or filling nozzle 53. While the second embodiment 60*b* of the exhaust manifold 60 is depicted in the Figures, it is understood that the other disclosed embodiment 60*a* of the exhaust manifold 60 is equally applicable to the disclosed method of the invention.

When the pillow liner is filled to the customer's personal preference, the second vacuum pump 32 is turned off and the blast gate mechanism 52 is closed to stop the flow of feather down material 21 between the first 20 and second chamber 30. The exterior door 36 may then be opened and the article liner or casement 80 removed from the filling nozzle 53 of the passageway 50. The article liner or casement is closed (e.g., with a zipper) and the process is complete.

In addition, it should be noted that the embodiment of the subject invention 10 depicted in the Figures includes a base cabinet 18 and top 12 which are substantially deeper than the upper cabinet 14. Lights may be configured in the top 12 so as to illuminate an advertising surface 72 positioned on the back of the upper cabinet 14. Thus, when not in use the front of subject invention 10 may be pushed against a wall so as to display only the advertisement. Moreover, the substantially deeper base cabinet 18 also allows the lower or base cabinet 18 to include a storage area 70 having a pull-out shelf 62 onto which a sewing or embroidery device 64 or other supplies may be located. The sewing or embroidery device 64 allows for the immediate monogramming and customization of the article's outer casement or shell. To further enhance the retail experience, a variety of scented herb sachets are also available (lavender and martini dreams scents) for addition to the article liner or casement. After filling the article liner or casement, then slipping it inside a monogrammed exterior casement or shell and adding the sachet, the entire experience is complete and the customer has a customized, monogrammed and scented down-filled article (e.g., a pillow) to take home or give as a gift.

It will now be evident to those skilled in the art that there has been described herein an improved apparatus and method for facilitating the filling of articles and casements with feather down by inducing a partial vacuum on the exterior of the air-permeable fabric casement thereby causing the feather down to be sucked into the bag in a clean, efficient and controlled manner.

Although the invention hereof has been described by way of a preferred embodiment, it will be evident that other adaptations and modifications can be employed without departing from the spirit and scope thereof For example, the upper and lower chambers need not be of the same size. In a more commercialized application, a single upper chamber could serve as the storage chamber for a plurality of lower chambers. Each lower chamber in such an arrangement would include a separate passageway, nozzle and gate mechanism and a mechanism for selectively inducing a vacuum in that particular lower chamber. While inducing such a vacuum, the exhaust from the vacuum inducing mechanism could be routed to the common upper chamber.

In addition, while the mechanism for selectively inducing a partial vacuum in the embodiment of the subject invention depicted in the Figures comprises two vacuum pumps 32, 42, it is understood that the mechanism could comprise a single vacuum pump with some slight modifications. For example, the second vacuum pump 32 could be used to perform both tasks. The vacuum pump would simply require a selective intake and exhaust manifold to control the airflow as depicted in accordance with the method of the invention.

The terms and expressions employed herein have been used as terms of description and not of limitation; and thus, there is no intent of excluding equivalents, but on the contrary it is intended to cover any and all equivalents that may be employed without departing from the spirit and scope of the invention.

The invention claimed is:

1. An apparatus for filling an air-permeable casement with feather down material comprising:

a first chamber for holding a supply of said feather down material;

a second chamber fluidly connected to said first chamber by a passageway having a nozzle extending into said second chamber, a mechanism for selectively and separately inducing a partial vacuum in each of said chambers, wherein said fabric casement is filled with feather down material by attaching said casement to said nozzle and inducing a first partial vacuum in said second chamber so as to draw a portion of said feather down material from said first chamber into said casement.

2. The apparatus of claim 1, wherein said first chamber is filled with feather down material by closing off said passageway, fluidly connecting said first chamber to an external supply of feather down material, and inducing a second partial vacuum in said first chamber.

3. The apparatus of claim further comprising a pressurized exhaust which is vented into said first chamber.

4. The apparatus of claim 3, wherein said pressurized exhaust comprises a conduit fluidly connecting the pressurized exhaust from said vacuum inducing mechanism to said first chamber.

5. The apparatus of claim 4, wherein said pressurized exhaust further comprises an exhaust manifold located in said first chamber and in fluid communication with said conduit, wherein said manifold divides said pressurized exhaust into two diverged exhaust flows.

6. The apparatus of claim 5, wherein said exhaust manifold is positioned near the bottom of said first chamber.

7. The apparatus of claim 6, wherein one of said diverged exhaust flows is aligned in-line with said passageway.

8. The apparatus of claim 6, wherein said exhaust manifold includes two exhaust nozzles, which are laterally offset from one another, wherein said first exhaust nozzle directs a first diverged exhaust flow and said second exhaust nozzle directs a second diverged exhaust flow.

9. The apparatus of claim 8, wherein said first exhaust nozzle directs said first diverged exhaust flow in a first direction and said second exhaust nozzle divides said second diverged exhaust flow into two subsidiary flows and directs said subsidiary flows in directions which are at an obtuse angle from said first direction.

10. The apparatus of claim 9, wherein the relative height of said second exhaust nozzle above said first exhaust nozzle.

11. The apparatus of claim 1, wherein said mechanism for selectively inducing a partial vacuum comprises:

a first vacuum pump having an intake fluidly connected to said first chamber; and a second vacuum pump having an intake fluidly connected to said second chamber and a pressurized exhaust, which is vented into said first chamber.

12. The apparatus of claim 11, wherein said first vacuum pump is fluidly connected to said first chamber by means of a conduit extending from said intake of said first vacuum pump and terminating with a filtering mechanism configured in said first chamber.

13. The apparatus of claim 12, wherein said filtering mechanism is positioned near the top of said first chamber.

14. The apparatus of claim 1, wherein said nozzle includes a gate mechanism to selectively open or close said passageway.

15. A method for filling an air-permeable casement with feather down material comprising:

providing a first chamber and a second chamber and a mechanism for selectively and separately inducing a partial vacuum in each of said chambers, filling the first chamber with a supply of said feather down material;

fluidly connecting the first chamber to the second chamber with a passageway, said passageway including a gate mechanism in said passageway and a nozzle extending into said second chamber fixably attaching said easement about said nozzle; and inducing a first partial vacuum in said second chamber so as to draw a portion of said feather down material from said first chamber into said casement.

16. The method of claim 15, wherein the step of fluidly connecting said first chamber to said second chamber further comprises opening the gate mechanism in said passageway.

17. The method of claim 16, wherein said filling step further comprises:

closing said gate mechanism in said passageway;

connecting said first chamber in fluid communication to an external supply of feather down material; and inducing a second partial vacuum in said first chamber thereby drawing a portion of said external supply of feather down material into said first chamber.

18. The method of claim 17, wherein the step of inducing said second partial vacuum in the first chamber includes activating a first vacuum pump and the step of inducing a first partial vacuum in the second chamber includes activating a second vacuum pump.

19. The method of claim 15, further comprising venting a pressurized exhaust in said first chamber.

20. The method of claim 19, wherein said venting step comprises:

fluidly connecting said pressurized exhaust with an exhaust manifold configured in said first chamber, wherein said exhaust manifold divides said pressurized exhaust into a first and second diverged exhaust flows.

* * * * *